US005092245A

United States Patent [19]

Douglas et al.

[11] Patent Number: 5,092,245

[45] Date of Patent: Mar. 3, 1992

[54] EXPLOSIVE STEMMING DEVICE

[75] Inventors: Donald H. Douglas, Clinton; Stafford S. Cooper; Philip G. Malone, both of Vicksburg, all of Miss.

[73] Assignee: The United States of America as represented by the Secretary of the Army, Washington, D.C.

[21] Appl. No.: 553,829

[22] Filed: Jul. 18, 1990

[51] Int. Cl.[5] ..... F42B 3/00

[52] U.S. Cl. ..... 102/324; 102/323; 102/333

[58] Field of Search ..... 102/323, 324, 333

[56] References Cited

U.S. PATENT DOCUMENTS

| | | | |
|---|---|---|---|
| 119,330 | 9/1871 | Dickey | 102/324 |
| 2,216,067 | 9/1940 | Clark | 102/324 |
| 2,966,855 | 1/1961 | Barco | 102/324 |
| 4,464,994 | 8/1984 | Porter | 102/333 |
| 4,469,993 | 8/1984 | Porter | 102/312 |
| 4,492,165 | 1/1985 | Marz | 102/313 |

*Primary Examiner*—Peter A. Nelson
*Attorney, Agent, or Firm*—Darrell E. Hollis

[57] ABSTRACT

An explosive stemming device for dispensing granular material into a borehole containing an explosive charge therein is disclosed as including a cylindrical member having a flexible sleeve-like liner adapted to conform to the interior thereof when filled with granular material. One end of the liner is turned around an end of the cylindrical member and secured thereto while the other end of the liner is fixed to a centrally positioned pipe whereby extracting of the member containing granular material from the borehole causes everting or turning inside out of the liner and dispensing of the material in the borehole.

9 Claims, 1 Drawing Sheet

EXPLOSIVE STEMMING DEVICE

STATEMENT OF GOVERNMENT INTEREST

The invention described and claimed herein may be manufactured and used by or for the Government of the United States of America for governmental purposes without the payment of royalties thereon or therefor.

BACKGROUND OF THE INVENTION

The claimed invention relates to explosion stemming devices and more particularly, to such devices which are capable of insertion into boreholes for plugging the same preparatory to use of an explosive charge.

As practiced in the art, explosive stemming devices allow sand, cement or other solid or semi-solid materials to be dispensed directly above an explosive charge placed in a borehole. The device is arranged to place the stemming material in a compact column above a plug or formation packer without producing voids or bridging in the borehole. Without a stemming device, the granular material or cement must be pumped or prodded into position. Dispensing a uniform column of material from a conventional hopper or bailer is difficult, if not nearly impossible, because any moist granular material of sand size will bridge inside the bailer and not flow out.

Explosive stemming is typically accomplished by pumping a cement-based grout into a borehole or by pouring loose granular material such as sand into the top of the borehole. A stemming device has been developed by a leading designer which dispenses dry granular material through a trap door operable by use of an explosive squib. The device is lowered down in a borehole and opened to release the stemming material.

The disadvantage in this design is that the granular stemming material, generally sand, will dispense easily only if the granular material is completely dry or completely saturated. In the event the borehole is underwater, water will move into the dry material and can cause clogging. The stemming devices in present use will operate dependably when used only with a dry charge of granular material in a dry borehole.

Therefore, it is the principal object of the claimed invention to dispense stemming material in a borehole containing an explosive charge whereby voids and bridging of the material during dispensing is prevented.

Another object of the invention is to dispense stemming material in a borehole regardless of its moisture content and even to the extent that the borehole is underwater.

The claimed invention has been devised so that stemming granular material is dispensed in a borehole at an even, progressive rate. To this goal, an open-ended cylinder for the insertion of the material into the borehole includes a sleeve-like liner within its interior and having a size which will permit the wall of the sleeve to conform to the inner surface wall of the cylinder. The ends of the sleeve liner protrude slightly beyond the adjacent ends of the cylinder and are arranged so that one of the ends of the liner is turned back upon the corresponding end of the cylinder and fastened to the outer surface of that end of the cylinder.

An elongated pipe is positioned internally into the cylinder coincident with its axis and beyond its ends, and with one end terminating in a gasket of a size to surround the lower open end of the cylinder to which the liner is secured. Prior to use, the gasket is placed on top of the plug for an explosive charge. Granular stemming material is poured into the sleeve in the annular space between the pipe and the liner and is sealed at the lower end of the cylinder by the gasket. When filled, the upper end of the liner sleeve is tied or taped to the pipe. The operator extracts the cylinder by its upper end which causes the liner to evert or turn itself inside out to effect dispensing of the material into the borehole as the cylinder is being extracted. In this process, the pipe and gasket remain in the borehole while the cylinder and liner, after complete removal, may be used for another operation.

These and other objects may become apparent after studying the following description taken in conjunction with the accompanying drawings.

DESCRIPTION OF THE PREFERRED EMBODIMENT

Figure 1:
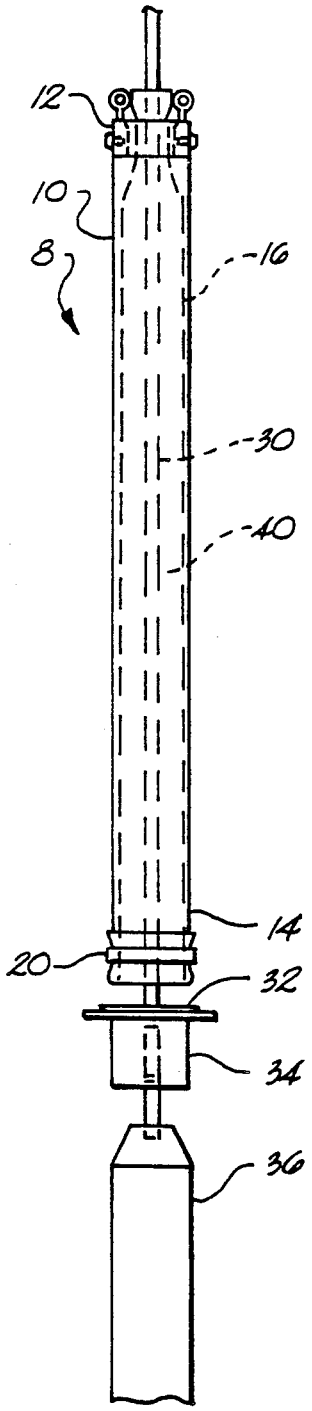
FIG. 1 is a plan view in cross section showing the stemming device in accordance with the claimed invention.

As shown in FIG. 1, the explosive stemming device 8 of the claimed invention includes a cylindrical member 10, open at the top and bottom ends, 12, 14, respectively, and having a flexible sleeve-like liner 16 positioned within the cylinder along its entire length and extending slightly beyond the ends thereof. The cylinder 10 may be made of metal or rigid plastic, and the liner 16 made from either cloth or wire fabric or comprises a plastic membrane.

The outer diameter of the cylinder 10 is selected to allow the cylinder to be lowered into a borehole without being obstructed by irregularities which may be formed on the borehole walls. The length of the cylinder is devised so as to provide sufficient volume of granular material to stem the borehole successfully. For example, a four inch diameter cylinder may be utilized to stem a borehole having a six inch diameter.

The sleeve liner 16 which is adapted to line the interior of the cylinder 10 for most of its length is longer than the cylinder so as to project slightly beyond the ends 12, 14, and has a diameter slightly smaller than the cylinder.

Figure 2:
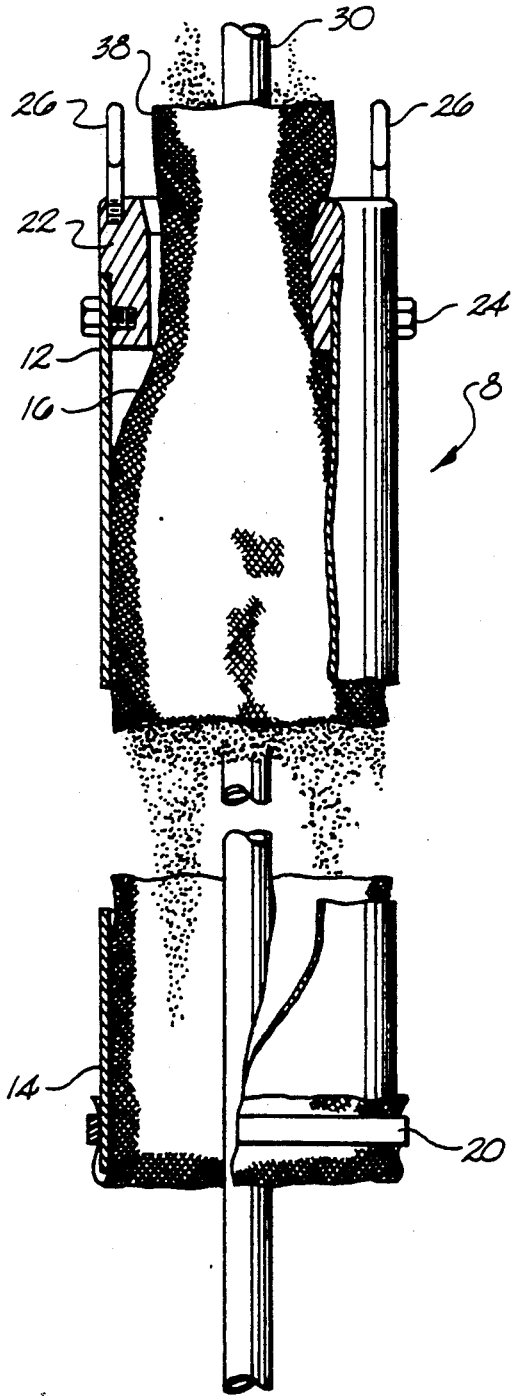
FIG. 2 is an enlarged expanded view partly in section showing the details of the end structures of the stemming device.

As shown in FIG. 2, the lower end of the sleeve liner 16 is flared so that the end is large enough or stretchable so as to be turned over the lower end of the cylinder and be applied to the outside surface of the cylinder 10. After being turned over, the end of the liner is clamped to the outside surface of the end 14 of the cylinder by means of any suitable means such as an elastic band 20. As will be described below, the upper end of the liner extends above the upper end 12 of the cylinder.

At the upper or top end 12 of the cylinder 10, a metallic lifting collar 22 is positioned inside the cylinder to be encircled thereby and secured thereto by screws 24. A pair of eye-bolts 26 are fastened to the upper side of the collar 22 for attachment to lifting cables (not shown) when the cylinder is to be extracted from a borehole.

An elongated pipe 30 is positioned within the cylinder 10 generally coincident with its axis and being of a length to extend beyond both ends of the cylinder. The lower end of the pipe when in a borehole terminates in a rubber gasket element 32 which is adapted to be positioned upon a plug 34 for an explosive charge 36 previously inserted in the borehole.

The gasket has a diameter larger than the diameter of the cylinder 10 and is adapted to seal the lower end of the cylinder when placed thereon during use of the stemming device. This diameter is also large enough to fit tightly against the wall of the borehole. The plug 34 with the rubber gasket 32 is used to hold stemming material at a specified depth in the borehole and serves as the bottom floor for the lined cylinder.

In operation, the entire stemming device 8 is assembled by sliding the cylinder 10, with the liner 16 attached, over a length of the pipe 30. The pipe allows the stemming cylinder to be lowered into place and also provides a conduit for directing blasting wire down to the explosive charge 36. With the lower end 14 resting upon the gasket 32 and plug 34, stemming material such as sand, cement or any other solid or semi-solid material is poured into the liner 16 around the pipe 30 from the open upper end 38 of the liner. The diameters of the pipe 30 and cylinder 10 are selected so as to allow an annular space 40 between the pipe and the inside of the lined cylinder, and the material is directed into this space and for the entire length of the cylinder.

When the cylinder is full, the top 38 of the liner 16 is tied or taped loosely to the centrally positioned pipe 30. With the liner closed, the stemming device 8 is lowered into a borehole, and as it is lowered, additional pipe 30 may be added. When the desired depth is reached, the pipe 30 is clamped within the borehole to hold the plug at a required level.

A lifting cable or harness (not shown) is attached to the lifting eyes 26 and lifting force applied thereto to commence extracting the cylinder 10 from the borehole. During lifting, the sleeve liner 16 turns inside out, or everts, thereby releasing the granular material which falls upon the gaskets 32 on the plug 34. After the cylinder 10 with the liner is completely extracted from the borehole, the upper end 38 of the liner is detached from the pipe 30 and may be reused along with the cylinder.

From the foregoing, it will be appreciated that the stemming device, by virtue of the everting action of the liner, is adapted to dispense granular material regardless of moisture content, and that any propensity for clogging or bridging of the material is eliminated. It will also be appreciated that the liner supports the column of particulate material and reduces or eliminates the friction between the material and the inner cylinder walls. In addition, the liner also equalizes pressure inside and outside the cylinder so that the cylinder is not closed by hydrostatic pressure.

While the invention has been disclosed with reference to the structure disclosed, it is not confined to the details set forth but is intended to cover such modifications or changes as may come with the scope of the appended claims.

What is claimed is:

1. An explosive stemming device for dispensing granular material into a borehole in which an explosive charge is retained, comprising:

a cylindrical member adapted to be inserted into and removed from the borehole, an elongated element within said member having one end arranged to be held within the borehole adjacent the explosive charge, a flexible sleeve element arranged along the inner wall of said member, said sleeve element having one end wrapped around the end of said member adjacent the explosive charge and attached to the outer surface of said member, and its other end attached to said elongated element adjacent the other end of said cylindrical member to define an annular space between said elongated element and said sleeve element to contain the granular material therein, and means for extracting said member from the borehole whereby the granular material is dispensed from said annular space by the everting action of said sleeve element in accordance with said extracting movement of said member.

2. A method for stemming a borehole having an explosive charge positioned therein with granular material comprising:

inserting a cylindrical member having a flexible sleeve-like liner arranged therein with one end turned around and secured to the inserted end of the member, and its other end being open and positioned adjacent the other end of said member, filling said member with granular material at said other end whereby said member becomes lined with said liner closing said other end of said liner, and extracting said member from the borehole while holding said other end of said liner against movement whereby the same everts to dispense the material in the borehole during the extracting movement.

3. The stemming device according to claim 1 wherein said everting means includes an elongated element positioned within said cylindrical member and arranged for defining an annular space between the same and said sleeve for holding the granular material therein.

4. The stemming device according to claim 1 wherein said everting means includes means for securing one end of said sleeve to one end of said cylindrical member and the other end of said sleeve to a fixed element adjacent the other end of said member.

5. The stemming device according to claim 1 including a plugging element associated with said cylindrical member for preventing removal of the granular material prior to said extracting movement thereof.

6. The stemming device according to claim 1 wherein said sleeve element is a plastic membrane.

7. The stemming device according to claim 1 wherein said sleeve element is made from wire fabric.

8. The stemming device according to claim 1 wherein said sleeve element is made from permeable material.

9. The stemming device according to claim 1 wherein said sleeve element is made from non-permeable material.

* * * * *